United States Patent [19]

Sando et al.

[11] 4,416,123

[45] Nov. 22, 1983

[54] APPARATUS FOR WET HEAT TREATING A TEXTILE PRODUCT

[75] Inventors: Yoshikazu Sando; Hiroshi Ishidoshiro, both of Wakayama, Japan

[73] Assignee: Sando Iron Works Co., Ltd., Wakayama, Japan

[21] Appl. No.: 294,388

[22] Filed: Aug. 19, 1981

[30] Foreign Application Priority Data

| | | | |
|---|---|---|---|
| Sep. 16, 1980 | [JP] | Japan | 55-128399 |
| Oct. 17, 1980 | [JP] | Japan | 55-145517 |
| Oct. 17, 1980 | [JP] | Japan | 55-145518 |
| Nov. 18, 1980 | [JP] | Japan | 55-162240 |

[51] Int. Cl.[3] ..... D06B 3/12; D06B 23/18

[52] U.S. Cl. ..... 68/5 E; 68/9; 68/181 R

[58] Field of Search ..... 68/5 E, 181 R, 9

[56] References Cited

U.S. PATENT DOCUMENTS

| | | | |
|---|---|---|---|
| 1,497,075 | 6/1924 | Elliott | 68/5 E |
| 2,641,121 | 6/1953 | Belcher | 68/181 R |
| 3,981,162 | 9/1976 | Kleir | 68/9 X |
| 4,055,970 | 11/1977 | Sando et al. | 68/5 E |
| 4,182,141 | 1/1980 | Sando et al. | 68/5 E |

FOREIGN PATENT DOCUMENTS

| | | | |
|---|---|---|---|
| WO79/0006-78 | 9/1979 | PCT Int'l Appl. | 68/5 E |

*Primary Examiner*—Philip R. Coe

*Attorney, Agent, or Firm*—Toren, McGeady and Stanger

[57] ABSTRACT

Methods for wet heat treating a textile product continuously in a high pressure steamer provided with a seal mechanism respectively at the cloth inlet and the cloth outlet of the steamer body, comprising (1) soaking a textile product to be treated with a treating solution in a liquid seal tank provided in the inlet side seal mechanism of the steamer body and wet heat treating the resultant textile product continuously in the steamer body while soaking the textile product further occasionally with the treating solution overflowing from the liquid seal tank into one or more liquid apply tanks for repeating steaming and boiling alternately, (2) wet heat treating a textile product previously soaked with a treating solution continuously in the steamer body and then prewashing the thus wet heat treated textile product continuously in the steamer body with the use of high temperature washing water overflowing from a slow cooling tank provided in the outlet side seal mechanism of the steamer body, and (3) the combination of (1) and (2), and apparatuses therefor.

4 Claims, 2 Drawing Figures

APPARATUS FOR WET HEAT TREATING A TEXTILE PRODUCT

BACKGROUND OF THE INVENTION

The present invention relates to apparatuses for wet heat treating textile products such as cloths and yarns continuously in order to subject the textile products to such treatment as pretreatment including desizing, scouring and bleaching, and dyeing effectively.

In subjecting a textile product to such treatment as pretreatment and dyeing commercially, it has usually been done to wet heat treat the textile product soaked with a treating solution such as a pretreating solution and a dye solution in a steamer at a temperature below 100° C. in batches discontinuously. The process has however such drawbacks that a large heat energy is consumed, the degree of dyeing differs batch to batch, and it needs a long while uneconomically until the treatment is completed.

The present inventors have disclosed the use of a high pressure steamer with which pretreatment and dyeing of a long textile product can be done continuously and speedily in a second level by wet heat treating a textile product soaked with a treating solution therein, and this apparatus is under practical application with a favorable result. However, in this high pressure steamer, since the textile product is soaked with a treating solution only one time in wet heat treating the resultant textile product, the application of the treating solution is frequently insufficient and not uniform, resulting in an unsatisfactory result. Particularly, more than one piece of a cloth can not be treated in piling the pieces en bloc.

In such a high pressure steamer, the wet heat treated textile product can be prewashed effectively in the steamer body by utilizing the effect that a textile product immediately after wet heat treated is in a swollen state to be easily washed. However, the interior of a steamer body is maintained with a wet heat usually as high as about 150° C. and washing water to be supplied from outside of the steamer body is usually at the ordinary temperature of about 20° C., having a tolerably large temperature difference therebetween. Therefore, in supplying washing water to the steamer body for prewashing the textile product, the temperature of the interior of the steamer body is lowered to condense the steam therein, and thus the wet heat in the steamer body is decreased, preventing a satisfactory wet heat treatment and consuming a large heat energy.

SUMMARY OF THE INVENTION

Under such circumstances, the object of the present invention is to offer an apparatus for wet heat treating a long textile product comprising cloths or yarns continuously and eminently in a high pressure steamer provided with a seal mechanism respectively at the inlet and the outlet of the steamer body for transporting the textile product continuously therethrough by maintaining the interior of the steamer body with a prescribed high temperature wet heat (hereinafter will be called cloth inlet and outlet) by eliminating the above-mentioned drawbacks.

The essential points of the invention comprise (1) soaking a textile product to be treated with a treating solution such as a pretreating solution or a dye solution in a liquid seal tank provided in the inlet side seal mechanism of the steamer body and wet heat treating the resultant textile product continuously in the steamer body while soaking the textile product further occasionally with the treating solution overflowing from the liquid seal tank into one or more liquid tanks for repeating steaming and boiling alternately, (2) wet heat treating a textile product previously soaked with a treating solution continuously in the steamer body and then washing the thus wet heat treated textile product continuously in the steamer body with the use of high temperature washing water overflowing from a slow cooling tank provided in the outlet side seal mechanism of the steamer body, and (3) the combination of (1) and (2).

DETAILED DESCRIPTION OF THE PREFERRED EMBODIMENTS

Figure 1:
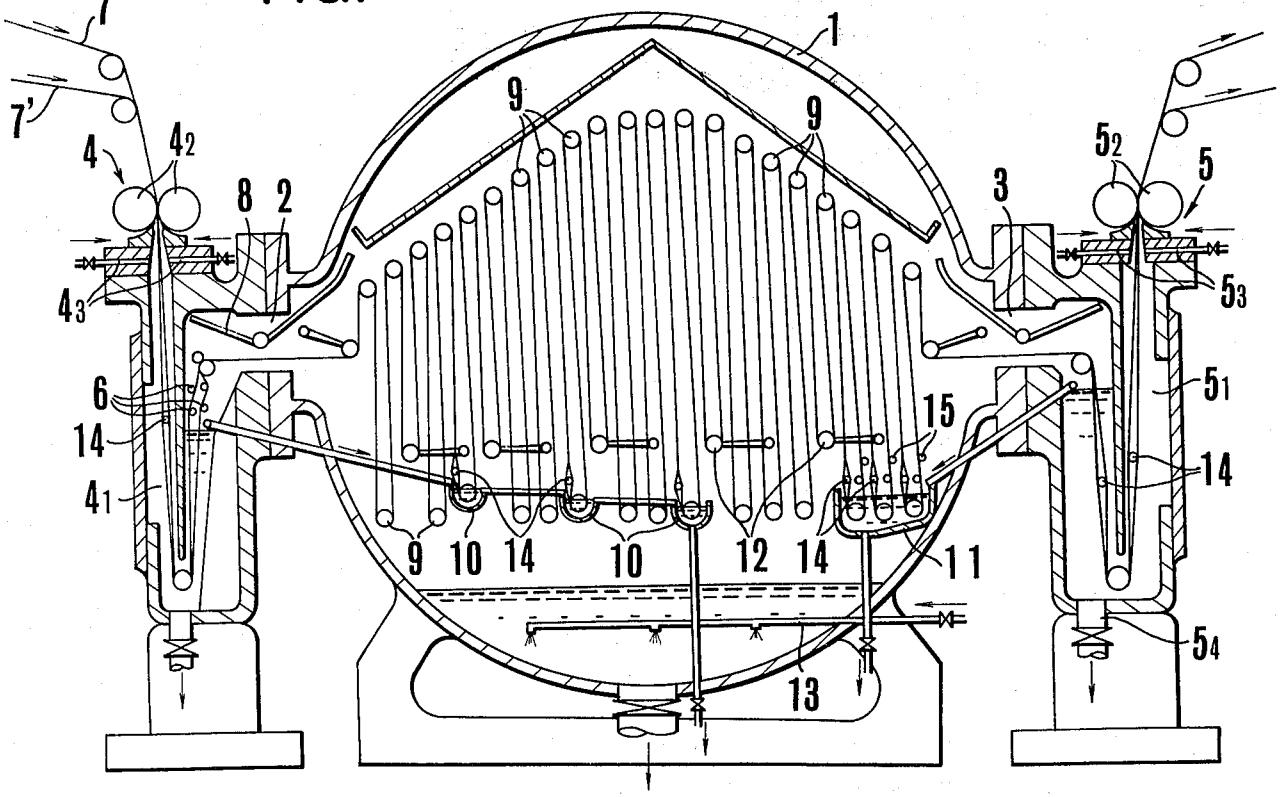
FIG. 1 is a sectional view of an example of the present inventive apparatus for wet heat treating a textile product and FIG. 2 is a sectional side view of another example of the present invention apparatus particularly showing the washing means provided therewith.

Preferred embodiments of the present invention will be described in detail in the following by referring to the drawings.

In FIG. 1, 1 is a high pressure steamer body for wet heat treating a textile product continuously. The steamer body 1 is provided with an inlet side seal mechanism 4 and an outlet side seal mechanism 5 respectively at the cloth inlet 2 and the cloth outlet 3 thereof for maintaining the interior of the steamer body with a high temperature and high pressure wet heat at a temperature of, for instance, from 100° to 160° C.

The inlet side seal mechanism comprises a nearly J-shaped liquid seal tank $4_1$ having a tolerably large difference of height, a pair of seal rubber rolls pressed against each other, $4_2$, for sealing the opening above the liquid seal tank $4_1$, and a liquid supply pipe $4_3$ provided above the liquid seal tank $4_1$ for supplying a treating solution. 6 are squeeze bars provided at the outlet of the liquid seal tank $4_1$ for removing the excess of the treating solution from the textile products 7 and 7' coming out of the liquid seal tank $4_1$. 8 is a water droplets preventing plate for preventing that water droplets fall on the textile products 7 and 7' until the textile product is transported in the steamer body 1. The outlet side seal mechanism 5 comprises a nearly U-shaped slow cooling tank $5_1$, a pair of seal rubber rolls $5_2$, a slow cooling liquid supply pipe $5_3$, and a slow cooling liquid discharge pipe $5_4$. A cooling liquid is circulated through the slow cooling tank $5_1$ at the ordinary temperature or under cooling so as to maintain the temperature thereof at about 50° C. at the exit of the slow cooling tank $5_1$.

In the steamer body 1, a plurality of guide rolls 9 for guiding a textile product (hereinafter will be called cloth guide rolls) are provided for transporting the textile product 7 and 7' up and down zigzag continuously therethrough. At the lower part of the steamer body 1, a number of liquid application tanks 10 are provided so as to receive the treating solution overflowing from the liquid seal tank $4_1$ successively therein for soaking the textile products 7 and 7' again with the treating solution during wet heat treatment. 11 is a washing tank for prewashing the wet heat treated textile products 7 and 7' in the steamer body with the use of hot water overflowing from the slow cooling tank $5_1$.

12 are tension control rolls substituting for the cloth guide rolls 9 at proper positions, and 13 is a steam supply pipe. 14 are separation bars for separating the textile products 7 and 7′ piled with each other temporary for the purpose to soak both sides of the textile product sufficiently with the treating solution or cooling water. In case when a single cloth is treated, the separation bars 14 can of course be dispensed with. 15 are squeeze bars for squeezing washing water from the textile product during prewashing.

In wet heat treating a long textile product, for instance two pieces of a cloth en bloc, continuously by using this apparatus, a treating solution, for instance an aqueous hydrogen peroxide solution or a caustic alkali solution for pretreatment and a dye solution for dyeing, is supplied from the liquid supply pipe $4_3$ into the liquid seal tank $4_2$, and the treating solution overflowing form the liquid seal tank $4_1$ is flowed down spontaneously into the liquid application tanks 10 successively. The treating solution overflowing from the last liquid application tank is discharged from the steamer body. On the other hand, the steamer body 1 is maintained wih a wet heat at a prescribed temperature by supplying superheated steam through the steam supply pipe 13.

Then, a textile product to be treated, for instance two pieces of a cloth 7 and 7′ piled with each other en bloc, is supplied through the inlet side seal mechanism 4 into the steamer body continuously. The textile product is soaked with the treating solution in the liquid seal tank $4_1$, and wet heat treated in the steamer body 1 while soaked again with the treating solution in the liquid application tanks 10 alternately to steam and boil the textile product repeatedly. The textile product is soaked with the treating solution sufficiently and uniformly and wet heat treated effectively.

After ending wet heat treatment, the textile product can further be washed preliminarily and effectively by immersing the textile product in hot washing water overflowing from the slow cooling tank $5_1$ in the washing tank 11. The textile product immediately after wet heat treatment is in a swollen state and the washing water coming from the slow cooling tank is as high as nearly 100° C. so that the washing water penetrates easily up to the core part of the textile product, and moreover, the textile product soaked with washing water is squeezed repeatedly by means of the squeeze bars 15. Therefore, the textile product can be prewashed quite effectively.

Figure 2:
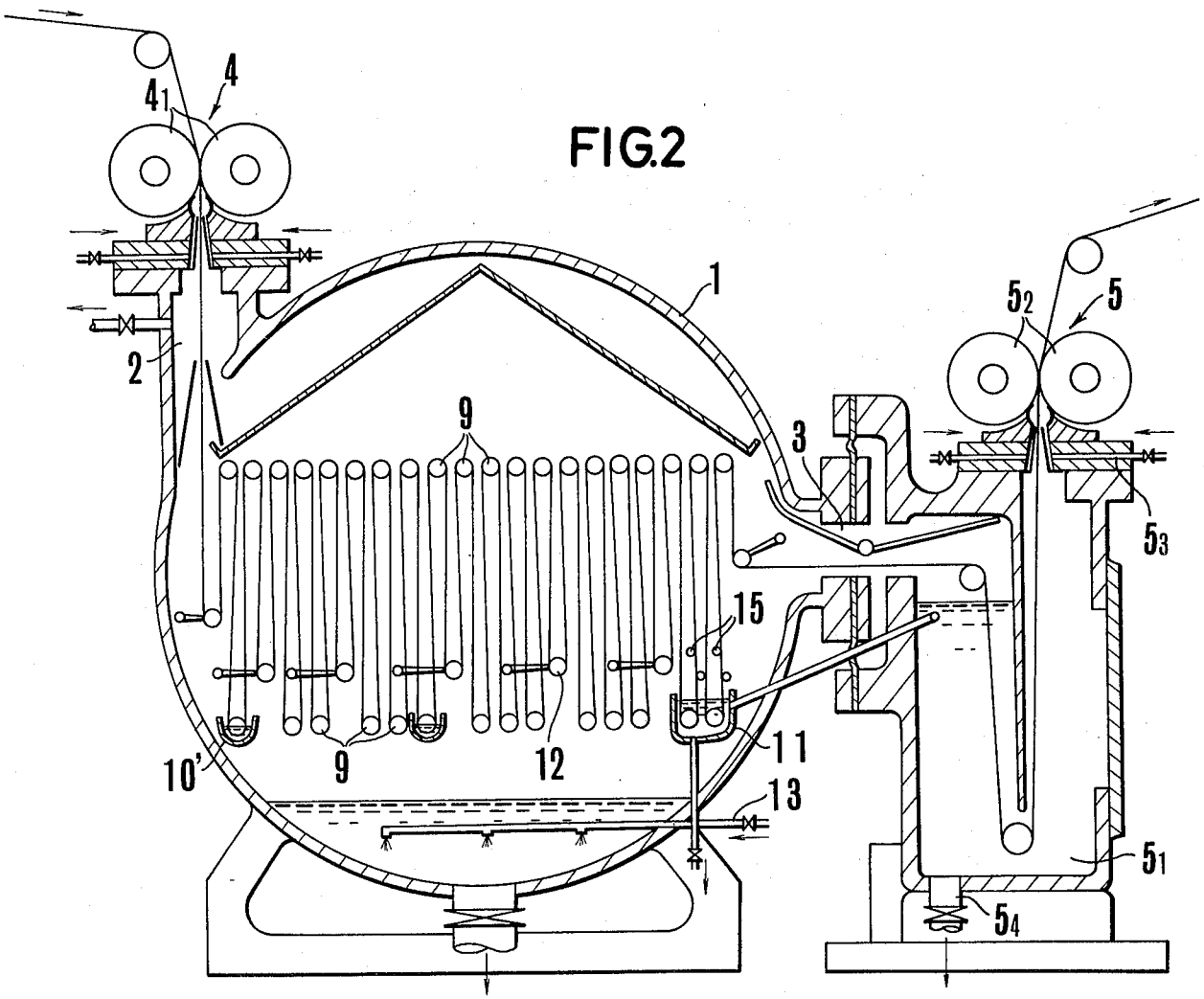

The apparatus shown in FIG. 2 is for wet heat treating and washing a textile product soaked with a treating solution at the outside of the steamer body in the steamer body. As compared with FIG. 1, the apparatus is lacking of a liquid seal tank in the inlet side seal mechanism, and the treating solution is supplied separately in the liquid application tanks 10′. Constructions of the other parts of the apparatus are similar as in FIG. 1.

A textile product to be treated is soaked with a treating solution at the outside of the steamer body, transported through the inlet side seal mechanism 4 into the steamer body 1, wet heat treated therein while soaking the textile product again with the treating solution occasionally and repeatedly with the use of the treating solution in the liquid application tanks 10′, and then washed preliminarily in the washing tank 11 by supplying hot washing water successively from the slow cooling tank $5_1$ provided in the outlet side seal mechanism 5 of the steamer body. The wet heat treatment and preliminary washing of a textile product can effectively be done as in the preceding example.

As described in detail in the above, in the present invention, since a constant amount of the treating solution is supplied successively in the liquid seal tank $4_1$ provided in the inlet side seal mechanism 4, in passing a prescribed textile product continuously under a constant rate, the concentration of the treating solution in the liquid seal tank $4_1$ can easily be controlled, and the textile product is soaked with the treating solution of constant concentration uniformly. Moreover, since a part of the treating solution in the liquid seal tank $4_1$ is supplied successively in the liquid application tanks 10 provided in the steamer body 1, the concentration of the treating solution in the series of the liquid application tanks 10 becomes gradually dilute, and therefore the concentration of the treating solution exiting from the end member of the liquid apply tank is very dilute, thus sparing the treating agent and preventing public pollution.

There is generally a tendency that impurities leaving the textile product adhere on the surface of the guide rolls 9, forming scales and staining the textile product, but, in the present invention, the textile product in contact with the cloth guide rolls has been moistened by immersing the textile product in the treating solution in the liquid application tanks 10 provided at proper positions in the steamer body. Therefore, the formation of scales on the surface of the guide rolls can be prevented, and even if scales are adhered partially on the cloth guide rolls, they can easily fall off due to the contact force of the textile product to the cloth guide rolls. The surface of the guide rolls can always be maintained clean without causing the trouble to stain the textile product in the present invention.

In the present invention, as already mentioned, two or more pieces of a cloth can be treated en bloc by piling one on the other, so that the capacity of the steamer body is increased economically, and uniform application of the treating solution is done with the use of the separation bars 15. Therefore, the present invention is suitable for mass production, sparing heat energy and water resources. Since the treating solution supplied to the liquid application tanks 10 has already been heated in the liquid seal tank $4_1$, there is no tendency that the temperature of the interior of the steamer body is lowered by supplying the treating solution in the liquid application 10, and the wet heat treatment can be done uniformly.

Furthermore, by immersing the wet heat treated textile product in washing water in the washing tank 11, the textile product can be prewashed effectively in a swollen state. Since washing water supplied in the washing tank has been heated in the slow cooling tank $5_1$, there is also no tendency that the temperature of the interior of the steamer body is lowered.

What is claimed is:

1. A high pressure steamer for wet heat treating a textile product continuously, comprising a steamer body having an inlet on one side and an outlet on the opposite side, an inlet side seal mechanism connected to and located outwardly from the inlet of said steamer body, an outlet side seal mechanism connected to and located outwardly from the outlet of said steamer body, said inlet and outlet side seal mechanisms arranged for maintaining high pressure and high temperature wet heat conditions in said steamer body, said inlet side seal mechanism including a liquid seal tank for holding a treating solution for immersing the textile product therein, means in said inlet side seal mechanism for guiding the textile product downwardly through said liquid seal tank and then upwardly to the inlet of said steamer body, at least one liquid application tank in said steamer body, means for conveying the treating solution from the liquid seal tank to said at least one liquid application tank for immersing the textile product therein.

2. A high pressure steamer for wet heat treating a textile product continuously comprising a steamer body having an inlet on one side and an outlet on the opposite side, an inlet side seal mechanism connected to and located outwardly from the inlet of said steamer body, an outlet side seal mechanism connected to and located outwardly from the outlet of said steamer body, said inlet and outlet side seal mechanisms arranged for maintaining high pressure and high temperature wet heat conditions in said steamer body, a washing tank positioned in the steamer body adjacent to said outlet for storing washing water therein for prewashing the textile product passing through said steamer body, a slow cooling tank in the outlet side seal mechanism of the steamer body, means for supplying water from said slow cooling tank into the washing tank, and means in said outlet side seal mechanism for guiding the textile product out of the outlet and through said slow cooling tank before the textile product exits from said outlet side seal mechanism.

3. A high pressure steamer for wet heat treating a textile product continuously comprising a steamer body having an inlet on one side and an outlet on the opposite side, an inlet side seal mechansim connected to and located outwardly from the inlet of said steamer body, an outlet side seal mechanism connected to and located outwardly from the outlet of said steamer body, said inlet and outlet side seal mechanisms arranged for maintaining high pressure and high temperature wet heat conditions in said steamer body, a liquid seal tank for holding a treating solution for immersing the textile product therein, means in said inlet side seal mechanism for guiding the textile product downwardly through said liquid seal tank and then upwardly to the inlet of said steamer body, a plurality of liquid application tanks arranged in laterally spaced relation in the steamer body, means for conveying the treating solution from the liquid seal tank successively to said liquid application tanks for immersing the textile product therein, a washing tank positioned in the steamer body adjacent to said outlet for storing washing water therein for prewashing the textile product passing through said steamer body, a slow cooling tank in the outlet side seal mechanism of the steamer body, means for supplying water from said slow cooling tank into the washing tank, and means in said outlet side seal mechanism for guiding the textile product out of the outlet and through said slow cooling tank before the textile product exits from said outlet side seal mechanism.

4. A high pressure steamer for wet heat treating a textile product continuously according to any of the claims 1, 2 and 3, in which separation bars are provided in the liquid seal tank, liquid application tanks, washing tank and slow cooling tank for separating the piled cloths where two or more pieces of a cloth are being wet heat treated en bloc.

* * * * *